United States Patent [19]

De Groat

[11] 4,063,853

[45] Dec. 20, 1977

[54] NOISE DAMPENING MEANS IN REFRIGERATION MOTOR-COMPRESSOR UNITS AND METHOD

[75] Inventor: Carl J. De Groat, Peterboro, N.Y.

[73] Assignee: Carrier Corporation, Syracuse, N.Y.

[21] Appl. No.: 684,520

[22] Filed: May 10, 1976

[51] Int. Cl.[2] ..... F04B 17/00; F04B 35/00

[52] U.S. Cl. ..... 417/53; 417/368; 417/902

[58] Field of Search ..... 417/363, 368, 415, 902, 417/53; 310/51; 184/6.23

[56] References Cited

U.S. PATENT DOCUMENTS

| | | | |
|---|---|---|---|
| 2,199,415 | 5/1940 | Philipp | 417/415 |
| 2,990,111 | 6/1961 | Bohn | 417/415 |
| 3,066,857 | 12/1962 | McCloy | 417/415 |
| 3,147,914 | 9/1964 | Hatten et al. | 310/51 |
| 3,817,661 | 6/1974 | Ingalls et al. | 417/312 |

*Primary Examiner*—William L. Freeh
*Assistant Examiner*—Thomas I. Ross
*Attorney, Agent, or Firm*—J. Raymond Curtin; Barry E. Deutsch

[57] ABSTRACT

A motor-compressor unit is resiliently mounted within a shell defining a lubricating oil sump. The compressor includes a primary oil pump having its inlet submerged in the oil sump to pump said oil to lubricate various compressor components. A secondary oil pump has its inlet in fluid flow communication with the oil sump. The secondary oil pump agitates said oil and increases the velocity thereof to cause any gas entrained therein to separate therefrom. The separated gas and agitated oil is directed by a distributor radially outward through the oil and over the outside surfaces of the compressor to absorb acoustical energy generated thereby.

9 Claims, 3 Drawing Figures

NOISE DAMPENING MEANS IN REFRIGERATION MOTOR-COMPRESSOR UNITS AND METHOD

BACKGROUND OF THE INVENTION

This invention relates to refrigeration apparatus, and more particularly, to an arrangement for dampening noise generated by the motor-compressor unit of said apparatus.

Refrigeration apparatus employed in air conditioning equipment for residential applications are generally located in areas that are either occupied, for example the well-known room air conditioners are typically mounted in windows or installed through the walls of rooms, or provided as a "split system" wherein the motor-compressor unit and condenser are mounted in a common housing and installed outdoors on a concrete slab or similar foundation. As is well recognized, it is important that such air conditioning equipment be limited generators of noise.

As is apparent, if the equipment is a noise generator, it will produce undesired disturbances in either the occupied space being served by such equipment, or if located outdoors, it may disturb not only the owner therof, but also the owner's neighbors who may reside in relatively close proximity to the air conditioning equipment.

As is well recognized, motor-compressor units of the type typically employed in air conditioning equipment of the type under discussion are one of the principal sources of noise generated by the equipment. The compressor employed to produce the high pressure refrigerant gas includes many moving components, all of which generate noise. Typically, in units of the type under discussion, the motor-compressor unit is resiliently suspended in a hermetically sealed shell. In order to reduce manufacturing costs, the size of the shell has been continually decreased whereby a substantial portion of the compressor unit is disposed in the oil sump defined by the interior surface of the shell. It has been found that the lubricating oil acts as a conduit for sound generated by the motor-compressor unit. In effect, such sound is transmitted by the oil to the shell from where it radiates to the surrounding ambient.

In order to reduce the transmission capability of the oil, many devices have heretofore been employed to aerate or agitate the oil. For example, in U.S. Pat. No. 2,990,111, there is disclosed a mechanical stirrer located in its entirety below the surface of the oil in the sump. The stirrer agitates the oil to produce bubbles therein to reduce the oil's transmission capability. In U.S. Pat. No. 3,066,857, a portion of the compressed gas is bypassed about the piston and is delivered to the lubricating oil through a suitable passage. The high pressure refrigerant gas causes the oil to foam or bubble to thereby reduce its noise transmitting capabilities. Another example of the prior art is disclosed in U.S. Pat. No. 3,147,914 wherein the rotor of the motor is submerged in the oil and agitates the oil as the rotor rotates. The several examples cited above all have a common feature. Each of the patents of the prior art agitate the oil to produce bubbles in the oil which tend to reduce the oil's noise transmission capability. However, none of the devices of the prior art are entirely satisfactory for one or more reasons.

For example, it has been found that by agitating or stirring the oil in the manner disclosed in U.S. Pat. No. 2,990,111, particles of debris usually found at the bottom of the oil sump are stirred about and sometimes find their way into the lubricating pump's inlet. This results in the particles being delivered to the various bearings of the unit to thereby reduce bearing life.

With reference to the device disclosed in U.S. Pat. No. 3,066,857, it has been found that the bubbles will be insufficiently distributed throughout the entire body of oil by merely causing refrigerant gas to bypass the piston. In addition, since the quantity of bypass gas is not constant due to manufacturing tolerances, sufficient quantities of bubbles are not always formed in the oil.

SUMMARY OF THE INVENTION

Accordingly, it is an object of this invention to dampen refrigeration motor-compressor units.

It is a further object of this invention to agitate the body of oil provided in the oil sump of a motor-compressor unit to reduce the noise transmission capability of the body of oil.

It is a further object of this invention to agitate the oil in a manner to prevent the disturbance of small particles of debris usually found at the bottom of the oil sump.

It is a further object of this invention to thoroughly distribute agitated oil and refrigerant gas to block the transmission path from the noise source, through the oil, to the outside shell.

It is yet another object of this invention to implement the foregoing without substantially increasing the manufacturing cost of the motor-compressor unit.

It is still another object of this invention to provide an arrangement of parts which dampen noise generated by the motor-compressor unit without having a detrimental effect on the operation of the primary oil pump employed in the compressor lubrication system.

These and other objects of the present invention are attained in a motor-compressor unit resiliently suspended within a shell defining a lubricating oil sump. The compressor includes a primary oil pump having its inlet submerged in the oil sump; the pump supplies oil to lubricate various compresor components. A secondary oil pump has its inlet in fluid flow communication with the oil sump. The secondary oil pump agitates said oil to cause entrained refrigerant gas to separate therefrom. The separated gas and agitated oil is directed by distribution means radially outward through the oil stored in the sump to particularly dampen noise transmitted from the peripheral surfaces of the compressor.

DESCRIPTION OF THE PREFERRED EMBODIMENT

Figure 1:
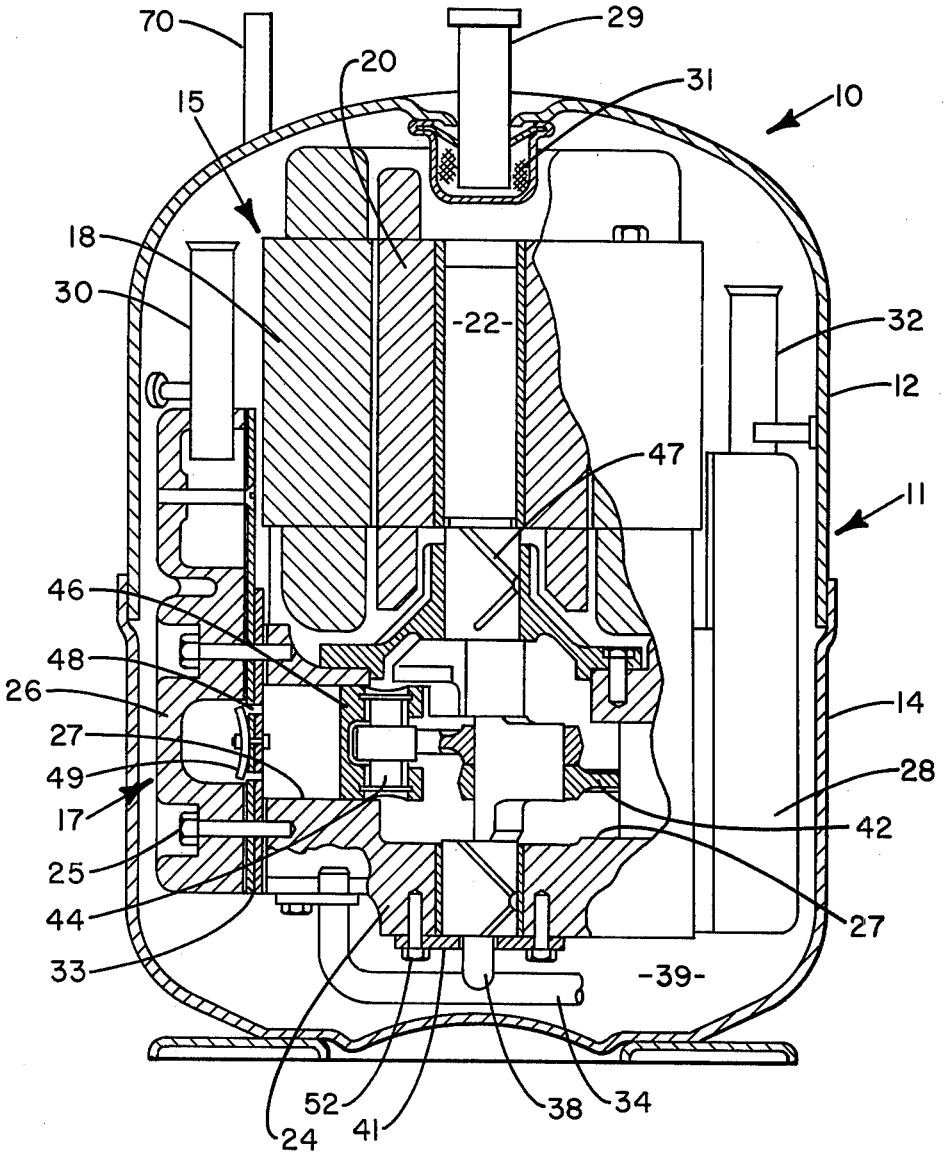
FIG. 1 is a longitudinal sectional view of a motor-compressor unit in which the instant invention is embodied.

Referring to the drawings, there is shown a hermetically sealed motor-compressor unit embodying the noise dampening system in accordance with the invention. A motor-compressor unit of the type illustrated is typically employed in a mechanical refrigeration unit.

The hermetically sealed motor-compressor unit is generally indicated at 10. The unit is housed within a shell generally indicated at 11 having an elliptical cross-sectional shape. Shell 11 is fabricated of lower shell section 14 and upper shell section 12 which are joined together, for example by welding. An electric motor indicated at 15 and a compresssor indicated at 17 are disposed within shell 11. Compressor 17 is axially aligned with motor 15 and is disposed therebelow.

Motor 15 includes stator 18 and rotor 20, the rotor being operatively connected to drive crankshaft 22. The crankshaft is supported within the cylinder block 24 of compressor 17. The cylinder block defines cylinders 27 of the compressor. Cylinder heads 26 and 28 are secured to the cylinder block by bolts 25 and are provided to enclose the ends of the cylinders. Pistons 46 are disposed within cylinders 27 for reciprocal movement therein. Any desired number of cylinders may be employed. Connecting the respective pistons to the eccentric portion of crankshaft 22 are connecting rods 42 and wrist pins 44. The desired reciprocating movement of the pistons is obtained by rotation of the crankshaft as is obvious to those skilled in the art.

The hermetically sealed motor-compressor unit embodying the present invention is typically employed in a mechanical refrigeration unit of the type generally used in air conditioning systems. The refrigerant gas to be compressed, enters into the shell of the compressor via inlet 29. The gas passes through inlet 29 and screen 31 and thereafter flows flows the windings of motor 15 to cool same in a manner well known to those skilled in the art. Screen 31 is included to remove any undesirable foreign particles that may be entrained in the entering refrigerant gas.

The refrigerant gas, after having cooled the windings of the motor, enters into the compressor portion of the unit via inlet tubes 30 and 32 disposed in the top portion of cylinder heads 26 and 28. The refrigerant gas enters each of the cylinders 27 of the compressor via suction ports (not shown) which are formed in valve plates 33. The gas, after it is compressed by operation of the piston, enters into an appropriate portion of the cylinder head through discharge ports 48 formed in valve plate 33. Discharge valve 49 connected to plate 33, regulates the flow of gas from the cylinder.

The discharged high pressure gas passes through internal bores of the cylinder block in a manner which is more fully explained in U.S. Pat. No. 3,785,453, assigned to the same assignee as the assignee hereof. Undesirable sound produced by the pulsating nature of the discharge gas is attenuated by directing the gas through the bores of the cylinder block. The gas thereafter flows through discharge line 34 which connects with discharge outlet 70 and is provided for transmitting the compressed gas to the other components of the refrigeration unit.

Lubricating oil for lubricating the various compressor components is stored in oil reservoir or sump 39 of the compressor. As it is desirable to maintain the size of the motor-compressor unit as compact as possible, generally the cylinder block and a portion of heads 26 and 28 attached thereto will be partially submerged in the body of stored oil. Sump 39 is defined by the inner wall of lower shell section 14. Oil pick-up tube 38 is submerged in the oil reservoir, so as to have its inlet below the surface of the oil. The tube is press fitted into an appropriate aperture formed in the bottom of crankshaft 22. Tube 38 passes through a suitable opening in thrust bearing 41. The thrust bearing is secured to the bottom surface of the cylinder block 24, by appropriate means such as bolts 52. During normal operation, rapid rotation of the tube caused by rotation of the crankshaft produces a vacuum at the tube's inlet, causing oil to flow thereinto. Crankshaft 22 has an internally bored eccentric passage 55 (shown in FIG. 2) provided therein which communicates with the upper end of tube 38. The centrifugal force developed by the oil passing into rotating eccentric passage 55 provides the necessary force for moving the oil through the passage. Feedholes 50 communicate the eccentric oil passage with bearing surfaces 43 and 49. Grooves 47 (see FIG. 1) are provided on the outer surface of crankshaft 22 to provide oil distribution to the bearing surfaces.

As has been previously recognized, the body of lubricating oil stored in sump 39 acts as a transmitting vehicle for noise generated by the movement of the various compressor components. Such noise is transmitted by the body of oil to hermetically sealed shell 11 from which such noise radiates to the ambient. As is obvious, when the refrigeration unit is employed in an air conditioning system to provide conditioned air to occupied spaces, the radiation of noise from the motor-compressor unit is highly undesirable. Heretofore, there have been many schemes to decrease the capability of the stored body of oil to transmit generated noise to the outer hermetically sealed shell.

Figure 3:
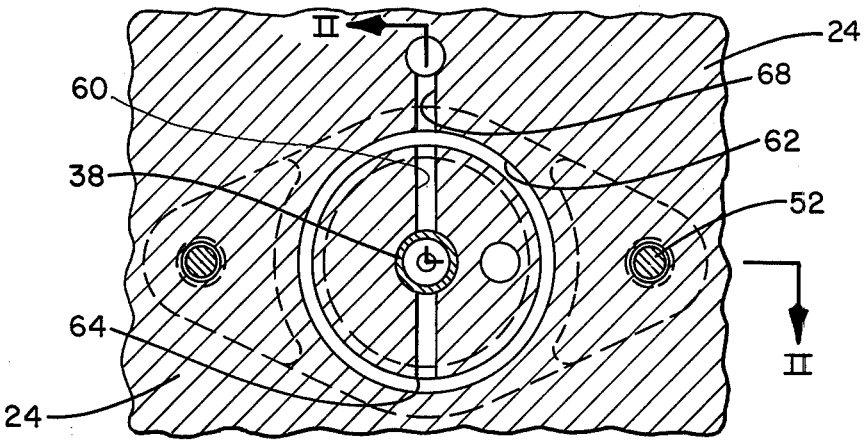
FIG. 3 is a sectional view taken along line III—III of FIG. 2.
Figure 2:
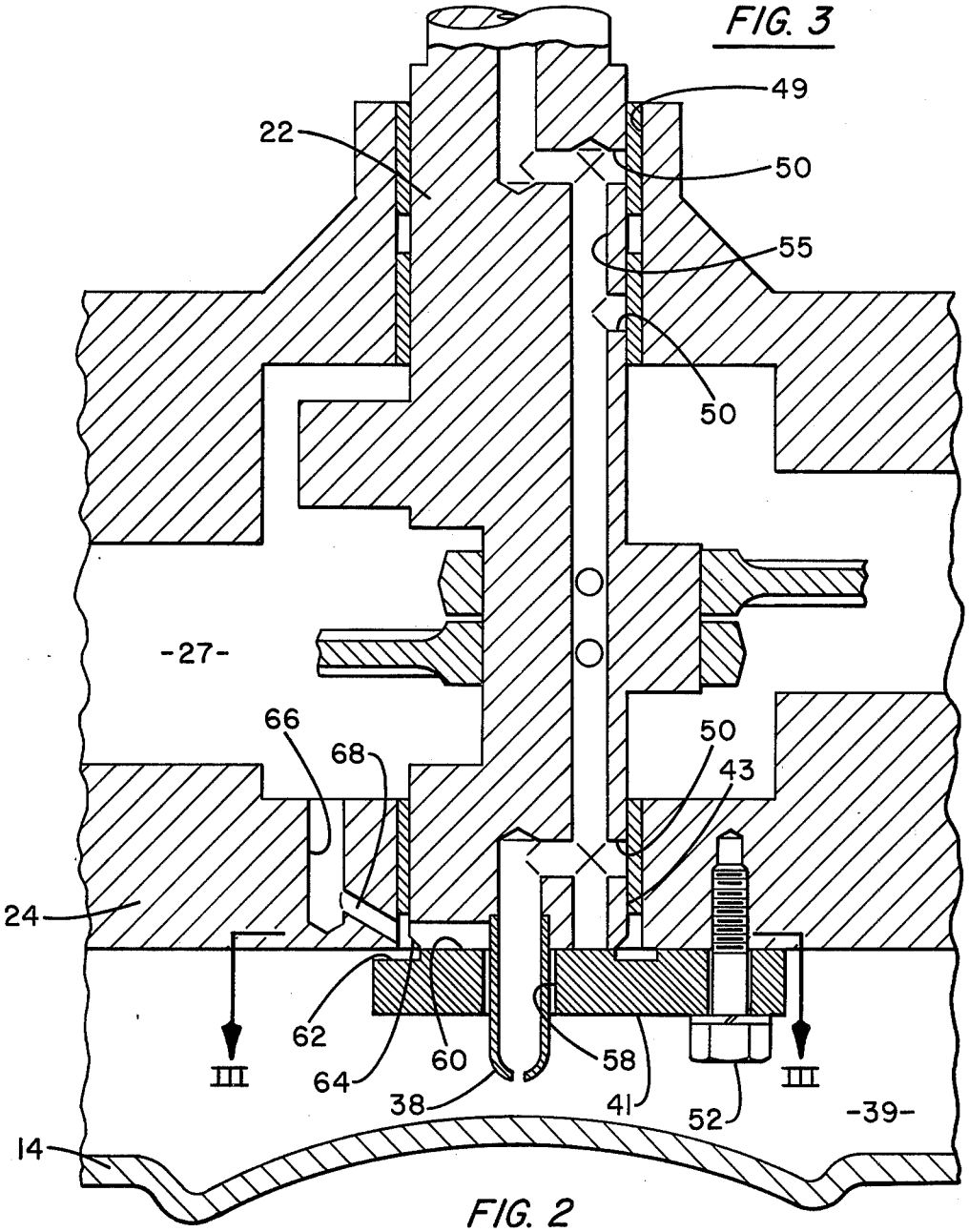
FIG. 2 is an enlarged partial sectional view, taken along line II—II of FIG. 3, illustrating the motor-compressor unit and showing details of the present invention.

Referring in particular to FIGS. 2 and 3, the details of the present invention will be described. The present invention provides an improved arrangement of parts to dampen the noise transmitted by the oil from the motor-compressor unit to the surrounding shell.

In particular, thrust washer 41 includes an annular opening 58 concentrically disposed relative to oil pick-up tube 38. Crankshaft 22 has a radially extending slot 60 in fluid flow communication with annular opening 58. It should be noted that annular flow opening 58 is submerged within the body of oil in sump 39. Thrust washer 41 preferably has an annular groove 62. The annular groove is in vertical alignment with the outboard end 64 of radially extending slot 60.

In operation, slot 60, in combination with opening 58, defines a secondary lubricating oil pump. A portion of the oil stored in sump 39 flows upwardly through annular opening 58 and passes into the center of radial slot 60. Rotating crankshaft 22 centrifuges the oil radially outward through slot 60. The oil thus centrifuged is greatly agitated. The centrifugal force developed by radially directing the oil through slot 60 causes the heavier oil to separate from the lighter refrigerant gas entrained therein. The agitation of the oil and refrigerant gas causes the refrigerant to foam.

The separated oil and refrigerant gas flow directly into groove 62 formed in washer 41 and are distributed thereby radially outward into the stored body of oil in sump 39. The agitated oil and foamed refrigerant gas produce bubbles in the body of oil, the bubbles being dispersed generally through the entire body of oil due to the radial direction in which the oil and gas are discharged from distribution groove 62.

Since substantial portions of the cylinder block and cylinder heads are submerged in the body of oil, the bubbles will generally surround all the submerged compressor surfaces. As is well recognized, the formation of bubbles in the oil will reduce the oil's sound transmitting capabilities.

By distributing the agitated oil and separated gas radially through the body of oil in sump 39, a sufficient quantity of bubbles will surround, for example, the cylinder heads to reduce the transmission of the noise generated by operation of the discharge and suction valves and heretofore transmitted from the cylinder heads, through the body of oil to shell 11.

In addition, by providing the inlet to the secondary oil pump generally at the top portion of the oil in sump 39, any debris or foreign particles residing at the bottom of sump 39 will not be disturbed. By permitting the debris to remain in a static state, such debris will generally not enter the inlet of either pick-up tube 38 or the entrance to annular opening 58. As is apparent, the passage of the debris into the lubrication system or noise dampening system of the present invention is highly undesirable.

With further reference to FIGS. 2 and 3, it may be desirable to further increase the agitation of the oil discharged into distribution groove 62 to increase the quantity of bubbles generated in the oil. To achieve the foregoing, a passage 66 is provided. Passage 66 communicates cylinder 27 with the oil and gas discharged from slot 60. High pressure refrigerant gas, which has bypassed piston 46 due to manufacturing tolerances provided between the piston rings and walls of cylinder 27, will pass through passage 66. The high pressure gas will further agitate the oil discharged from slot 60 to increase bubbles generated within the stored body of oil. Passage 66 may be directly aligned with distribution groove 62 or as shown, may include a communicating angular passage 68 which is in alignment with outboard end 64 of slot 60. If passage 68 is included, the bottom of passage 66 would be blocked by suitable means. The noise dampening system of the present invention has proven highly effective in reducing noise transmitted by the stored body of oil in sump 39 and is relatively inexpensive to implement as only several additional bores need to be drilled to provide the secondary pump.

While a preferred embodiment of the present invention has been described and illustrated, the invention should not be limited thereto, but may be otherwise embodied within the scope of the following claims.

I claim:

1. Refrigeration apparatus comprising:

a shell defining a lubricating oil sump;

a motor-compressor unit resiliently mounted within said shell, said compressor including a crankshaft connected to the rotor of said motor to rotate therewith;

first pump means having its inlet submerged in the oil contained in said sump to supply said oil to lubricate said compressor;

secondary pump means including an inlet for receiving a portion of said lubricating oil contained in said sump to agitate said oil and to cause any refrigerant entrained therein to separate therefrom as a gas; and distributor means to receive said agitated oil and separated refrigerant gas and direct said oil and gas radially outward through the oil stored in said sump to reduce the noise transmission capability of said stored oil.

2. A refrigeration apparatus in accordance with claim 1 wherein said crankshaft is connected to a piston reciprocally disposed within a cylinder defined by the compressor cylinder block, the fit between said piston and said cylinder permitting some compressed gas to bypass said piston; and passage means provided in said cylinder block to receive said bypassed compressed gas and direct same to intermix with said agitated lubricating oil and separated refrigerant gas.

3. A refrigeration apparatus in accordance with claim 2 wherein said secondary pump means includes a radial slot provided in said crankshaft, said lubricating oil entering said slot at substantially the center thereof, said oil being centrifuged outwardly in said slot whereby the oil is agitated to cause refrigerant entrained therein to separate therefrom.

4. A refrigeration apparatus in accordance with claim 1 wherein said secondary pump means include a radial slot provided in said crankshaft, said lubricating oil entering said slot at substantially the center thereof, said oil being centrifuged outwardly in said slot whereby the oil is agitated to cause refrigerant gas entrained therein to separate therefrom.

5. Refrigeration apparatus comprising:

a shell defining a lubricating oil sump;

a motor-compressor unit resiliently mounted within said shell and including a crankshaft connected to the rotor of said motor to rotate therewith;

a primary oil pump including a pickup tube submerged within the oil contained in said sump, and an eccentric oil passage provided in said crankshaft in fluid flow communication with the discharge opening from said oil pickup tube;

a thrust washer connected to said cylinder block, submerged in said oil, and including a central bore concentrically disposed with respect to said oil pickup tube to define therebetween an annular oil passageway;

a secondary oil pump having its inlet in fluid flow communication with said annular oil passageway and including a radially extending passageway provided in said crankshaft, with the oil flowing through said annular passageway passing into the center of said radial passageway, and being centrifuged outwardly to agitate said oil to cause refrigerant entrained therein to separate therefrom as a gas; and distribution means to receive said agitated oil and separated gas and direct said oil and gas radially outward through the oil stored in said sump to decrease the noise transmitted by the oil from the compressor to the shell.

6. A refrigeration apparatus in accordance with claim 5 wherein said crankshaft is connected to a piston reciprocally disposed within a cylinder defined by the compressor cylinder block, the fit between said piston and said cylinder permitting some compressed gas to bypass said piston; and passage means provided in said cylinder block to receive said bypassed compressed gas and direct same to intermix with said agitated lubricating oil and separated refrigerant gas.

7. A refrigeration apparatus in accordance with claim 6 wherein said distribution means includes an annular groove formed in said thrust washer in substantial vertical alignment with the outboard end of said radially extending passageway.

8. A refrigeration apparatus in accordance with claim 5 whereby said distribution means includes an annular groove formed in said thrust washer in substantial vertical alignment with the outboard end of said radially extending passageway.

9. A method of reducing the noise transmitting capability of a body of oil having a motor compressor unit partially submerged therein comprising the steps of:

agitating a portion of the body of oil to cause refrigerant entrained therein to separate therefrom as a gas;

directing the agitated oil and separated gas radially outward through the body of oil to form bubbles in the oil which reduce the noise transmitting capability of the body of oil; and directing compressed refrigerant gas toward said agitated oil and separated refrigerant gas to intermix therewith to increase the quantity of bubbles formed in the body of oil.

* * * * *